US007125219B2

(12) United States Patent
Sarin et al.

(10) Patent No.: US 7,125,219 B2
(45) Date of Patent: Oct. 24, 2006

(54) HIGH-PRESSURE FAN

(75) Inventors: Dan Sarin, Helskinki (FI); Kåre Lindroos, Espoo (FI); Joni Tallgren, Klaukkala (FI); Ilppo Sandberg, Espoo (FI); Jari Kuokkanen, Vantaa (FI); Jukka Blåfield, Espoo (FI); Olli Majamäki, Helsinki (FI)

(73) Assignee: Flakt Woods AB, Jonkoping (SE)

( * ) Notice: Subject to any disclaimer, the term of this patent is extended or adjusted under 35 U.S.C. 154(b) by 120 days.

(21) Appl. No.: 10/493,697

(22) PCT Filed: Nov. 11, 2002

(86) PCT No.: PCT/FI02/00885

§ 371 (c)(1),
(2), (4) Date: Aug. 4, 2004

(87) PCT Pub. No.: WO03/042545

PCT Pub. Date: May 22, 2003

(65) Prior Publication Data

US 2004/0247432 A1 Dec. 9, 2004

(30) Foreign Application Priority Data

Nov. 12, 2001 (FI) ..... 20012184

(51) Int. Cl.
*F04D 25/06* (2006.01)
*F04D 25/16* (2006.01)

(52) U.S. Cl. ..... 415/98; 415/100; 415/211.2; 416/198 R

(58) Field of Classification Search ..... 415/211.2, 415/214.1, 206, 99, 100, 98; 416/198 R, 416/198 A, 199, 230; 417/245–247, 350, 417/250, 244
See application file for complete search history.

(56) References Cited

U.S. PATENT DOCUMENTS 2,603,157 A * 7/1952 Conery ..... 417/81
2,814,254 A * 11/1957 Litzenberg ..... 417/350
3,094,272 A 6/1963 McClure
4,229,142 A * 10/1980 Le Dall et al. ..... 417/38
4,318,669 A 3/1982 Wennerstrom
4,558,992 A 12/1985 Hamano et al.
5,464,325 A * 11/1995 Albring et al. ..... 416/185
5,813,828 A * 9/1998 Norris ..... 415/115
6,196,809 B1 3/2001 Takahashi et al.

FOREIGN PATENT DOCUMENTS

| | | |
|---|---|---|
| FI | 101564 B | 7/1998 |
| GB | 702773 A | 1/1954 |
| GB | 920188 A | 3/1963 |
| JP | 10054395 A | 2/1998 |
| SU | 1710849 A1 | 2/1992 |

* cited by examiner

*Primary Examiner*—Ninh H. Nguyen
(74) *Attorney, Agent, or Firm*—Nixon & Vanderhye, PC

(57) ABSTRACT

The invention relates to a high-pressure fan which comprises an electric motor provided with a shaft that goes through it; blade wheels which are mainly made of a carbon fibre-based composite material, arranged on both sides of the electric motor and mounted directly on the shaft of the electric motor; fan housings surrounding the blade wheels; and an intermediate channel which connects a pressure opening of one fan housing to a suction opening of the other fan housing, the intermediate channel being integrated into the base structure of the high-pressure fan.

2 Claims, 1 Drawing Sheet

HIGH-PRESSURE FAN

This application is the US national phase of international application PCT/FI02/00885 filed in English on 11 Nov. 2002, which designated the US. PCT/FI02/00885 claims priority to FI Application No. 20012184 filed 12 Nov. 2001. The entire contents of these applications are incorporated herein by reference.

BACKGROUND OF THE INVENTION

The invention relates to a high-pressure fan which comprises an electric motor provided with a shaft that goes through it; blade wheels which are mainly made of a carbon fibre-based composite material, arranged on both sides of the electric motor and mounted directly on the shaft of the electric motor; fan housings surrounding the blade wheels; and an intermediate channel which connects a pressure opening of one fan housing to a suction opening of the other fan housing, the intermediate channel being integrated into the base structure of the high-pressure fan and located substantially below the electric motor and the blade wheels mounted to it.

This type of compact high-pressure fan except for the intermediate channel structure integrated to the base structure is known from FI patent 101564. When the blade wheels are made of a mainly carbon fibre-based composite material, the weight of the blade wheel is considerably reduced in comparison with the conventional steel and aluminium blade wheels. In spite of this, it has been possible to design the blade wheels at least as strong as when using the conventional materials. Due to the light weight of the blade wheels, they also do not require separate bearings and the bearings of the electric motor suffice. Due to the light weight of the rotating parts and the possibility to use smaller slide bearings instead of roller bearings, it has also been possible to raise considerably the rotation rate of the fan. The first critical rotation rate of the high-pressure fan is at the same time also at a higher level than that of the conventional solutions, which facilitates the use of rotating control in the entire area of operation, the control being easy to implement by means of a frequency converter.

The two series-connected steps of the high-pressure fan, i.e. the entities formed by each blade wheel and fan housing, are in this solution according to FI patent 101564 connected to each other by means of an intermediate channel running over the entire fan structure.

Even though this known high-pressure fan structure provides the significant advantages listed above, problems are still caused by said intermediate channel that requires a lot of space and causes vibration especially at high rotation rates.

An intermediate channel structure integrated to the base structure is in turn known from SU invention report 1710849.

BRIEF DESCRIPTION OF THE INVENTION

It is an object of the invention to improve the intermediate channel structure for use with the high-pressure fan known from FI patent 101564. This object is achieved by a high-pressure fan of the invention, which is mainly characterized in that the intermediate channel has, after the pressure opening, a direct channel section for levelling the flow, the length of the section corresponding substantially to the length of the long side of the pressure opening of the rectangular fan housing, and that a flow control plate is arranged at the end and in the middle of the flow-levelling channel section so as to turn the flow substantially 90 degrees.

The intermediate channel is placed inside the outlines that it has without the intermediate channel of FI patent 101564, since there is free space for auxiliary equipment inside these outlines, when this space and the auxiliary equipment are arranged in a suitable manner.

One advantage of the intermediate channel structure of the invention is a compact, space-saving structure that reduces the need for space on the site of use as well as freight costs when transporting the fan to the site of use. An especially high benefit is achieved, when the fan needs to be soundproofed with a soundproof enclosure, since then a lower structure also reduces the material costs of the enclosure.

An intermediate channel integrated to the base also adds to the rigidity of the entire fan, thus lowering the vibration level and extending the operating life. In addition to the rigidity, a lower centre of gravity is also obtained for the structure, whereby these two properties together shift the specific frequencies of the base structure to a higher frequency range, in other words, provide a wider rotation rate activity.

The fan can now also be mounted on vibroinsulators instead of directly on a concrete base, which would otherwise be obligatory due to the critical specific frequencies. The vibroinsulators, in turn, enable a freer placement of the fan, i.e. not only on the ground floor of a building as is usually the case when the fan is mounted directly on a concrete base.

BRIEF DESCRIPTION OF THE FIGURES

The invention will now be described in greater detail by means of a preferred embodiment and with reference to the attached drawing, in which.

DETAILED DESCRIPTION OF THE INVENTION

Figure 1:
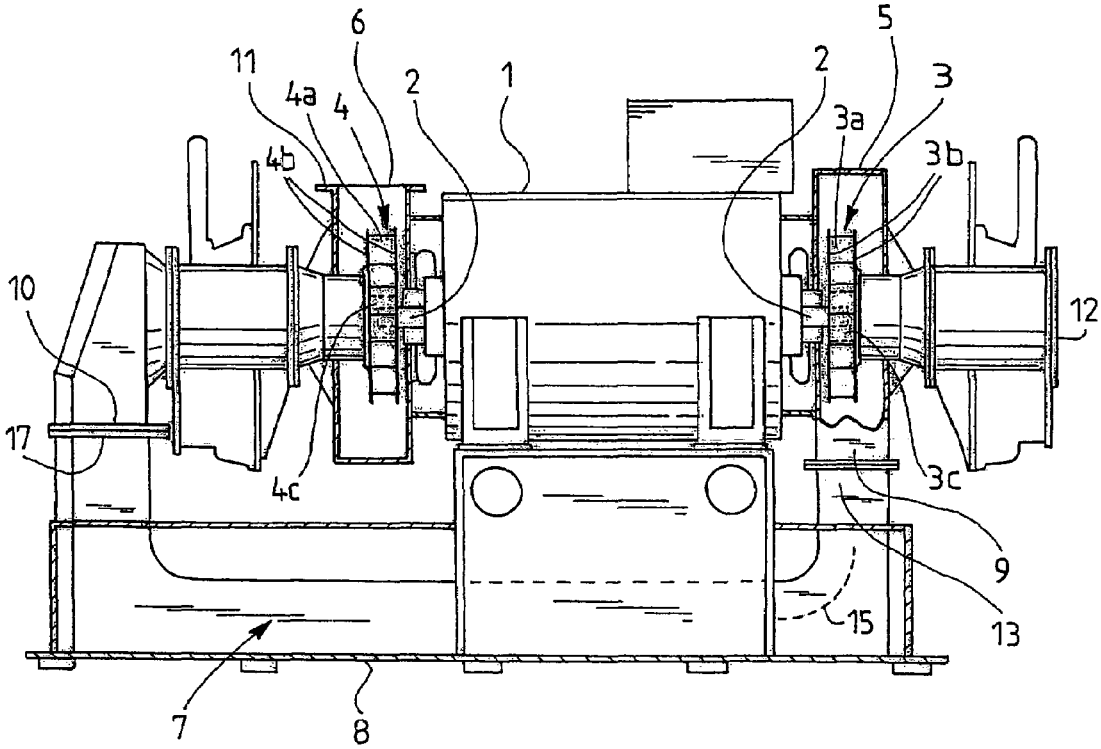
FIG. 1 shows a general view of a high-pressure fan of the invention.

FIG. 1 shows a high-pressure fan having an electric motor 1 with a rotor shaft 2 that goes through it, i.e. a shaft with its ends protruding from both sides of the motor, as its driving power source. A light blade wheel 3 and 4 made at least mainly of a carbon fibre-based composite material, i.e. at least the blades 3*a*, 4*a* and the end plates 3*b*, 4*b* are made of the material, is directly mounted without separate bearings to both ends of this shaft 2. The hub structure 4*c* of the blade wheel can also be made of some other material, such as steel. This direct mounting means that only the bearings of the electric motor are used in the mounting of the entire structure described above. The blade wheels 3 and 4 are surrounded by fan housings 5 and 6, and a pressure opening 9 of the first housing 5 is connected by an intermediate channel 7 to a suction opening 10 of the second housing. The pressure opening of the second housing is indicated with reference numeral 11 and the suction opening of the first housing with reference numeral 12. The entire fan structure described above is placed on a simple, steel base structure 8.

According to the invention, the intermediate channel 7 is integrated to the base structure 8 of the high-pressure fan below the electric motor 1 and the blade wheels 3 and 4 arranged to it.

Figure 2:
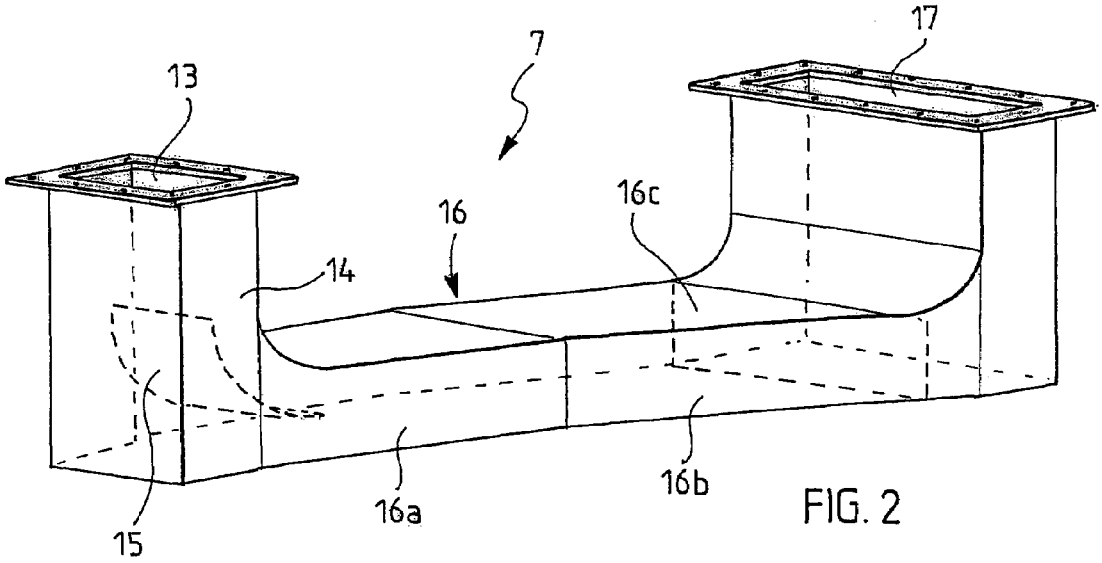
FIG. 2 shows the intermediate channel structure of the fan of FIG. 1.

According to FIG. 2, the intermediate channel 7 has, after a pressure opening 13 connected to the pressure opening 9 of the first housing 5, a direct channel section 14 for levelling the flow, the length of the section corresponding substantially to the length of the long side of the rectangular pressure opening 9 or 13.

A flow control plate 15 that is curved in the direction of the flow is arranged at the end and in the middle of the flow-levelling channel section 14 so as to turn the flow substantially 90 degrees.

The channel section 16 after the flow control plate 15 and connected to the flow-levelling channel section 14 substantially at a 90-degree angle comprises a two-part diffuser, the latter diffuser part 16*b* of which being in turn connected substantially at a 90-degree angle to a suction box 17 that is connected to the suction opening 10 of the second fan housing 6.

The cross-profile of the diffuser 16 increases towards the suction box 17 in such a manner that its mouth 16*c* corresponds to the cross-profile of the suction box 17.

The above description of the invention is only intended to illustrate the basic idea of the invention. A person skilled in the art may implement the details of the invention in a variety of alternative ways within the scope of the attached claims.

The invention claimed is:

1. A high-pressure fan comprising an electric motor provided with a shaft that passes through said motor; first and second blade wheels made substantially of a carbon fibre-based composite material, arranged on both sides of the electric motor and mounted directly on said shaft; first and second fan housings surrounding the first and second blade wheels respectively; and an intermediate channel which connects a pressure opening of the first fan housing to a suction opening of the second fan housing; the intermediate channel being integrated into a base structure of the high-pressure fan and located substantially below said electric motor and said blade wheels, wherein said intermediate channel has a pressure opening, a straight channel section for levelling the flow, a length of the section corresponding substantially to a length of a long side of said pressure opening of said first fan housing, and further wherein a flow control plate is arranged at one end and in a middle portion of the straight channel section so as to turn flow of air substantially 90 degrees.

2. A high-pressure fan as claimed in claim 1, wherein a portion of said channel section downstream of the flow control plate and connected to the flow-levelling channel section substantially at a 90-degree angle comprises a two-part diffuser, a downstream part of which being in turn connected substantially at a 90-degree angle to a suction box that is connected to the suction opening of the second fan housing.

* * * * *